US006896524B1

(12) United States Patent
Morello et al.

(10) Patent No.: US 6,896,524 B1
(45) Date of Patent: May 24, 2005

(54) LOW PROFILE SOCKET CONNECTOR

(75) Inventors: John R. Morello, Warren, OH (US); William G. Strang, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/767,989

(22) Filed: Jan. 29, 2004

(51) Int. Cl.[7] ..... H01R 12/00
(52) U.S. Cl. ..... 439/66
(58) Field of Search ..... 439/66, 71, 948, 439/357, 358, 350

(56) References Cited

U.S. PATENT DOCUMENTS 6,547,605 B2 4/2003 Daugherty et al.
2002/0025712 A1 * 2/2002 Mochizuki et al. ..... 439/357
2002/0119693 A1 * 8/2002 Chen ..... 439/358
2003/0008546 A1 * 1/2003 Nagamine et al. ..... 439/357

* cited by examiner

*Primary Examiner*—Phuong Dinh
(74) *Attorney, Agent, or Firm*—David P. Wood

(57) ABSTRACT

A low profile socket connector has a shroud for receiving a plug connector and a connector lock for retaining the plug connector when it is plugged into the socket connector. The exterior wall of the shroud has through slots extending through the exterior wall to form a lock arm connected to the remainder of the exterior wall of the shroud by flexible straps. The lock arm has a lock nib that extends inwardly of the lock arm beam to provide the connector lock. The lock arm includes a depressible release lever and a fulcrum located between the lock nib and the depressible release lever that extends inwardly of the lock arm for engaging a fulcrum support of the socket connector whereby the lock nib is moved outwardly away from the plug connector when the depressible release lever is depressed to release the plug connector.

14 Claims, 3 Drawing Sheets

LOW PROFILE SOCKET CONNECTOR

FIELD OF THE INVENTION

This invention relates to electrical connectors and more particularly to an electrical socket connector having a connector lock.

BACKGROUND OF THE INVENTION

U.S. Pat. No. 6,547,605 B2 granted to James Daugherty et al. Apr. 15, 2003 discloses an electrical socket connector having a conventional connector lock comprising a lock arm that is disposed inside a shroud attached to a connector body. The lock arm is integrally attached to the shroud by integral connector portions (not shown) that permit the lock arm to pivot with respect to the shroud. The lock arm has a lock nib at one end and a depressible pump handle at the other end that extends outwardly of the shroud. The lock nib snaps over and engages a lock shoulder of a mating connector body (not shown) when the mating connector body is plugged into the shroud. In order to unplug the mating connector body, the pump handle is depressed pivoting the lock nib outwardly out of engagement with the lock shoulder and releasing the mating connector body so that the mating connector body can be pulled out of the shroud.

This conventional connector lock has been used satisfactorily for many years. However, the arrangement has a high profile due to the shroud having an enlargement to house a portion of the lock arm inside the shroud. This high profile in turn increases the space requirements for using the conventional lock arm arrangement.

SUMMARY OF THE INVENTION

This invention provides a low profile socket connector having a shroud and a connector lock in which the enlargement for accommodating the connector lock has been eliminated by incorporating a lock arm in the shroud itself.

DETAILED DESCRIPTION OF PREFERRED EMBODIMENT

Figure 1:
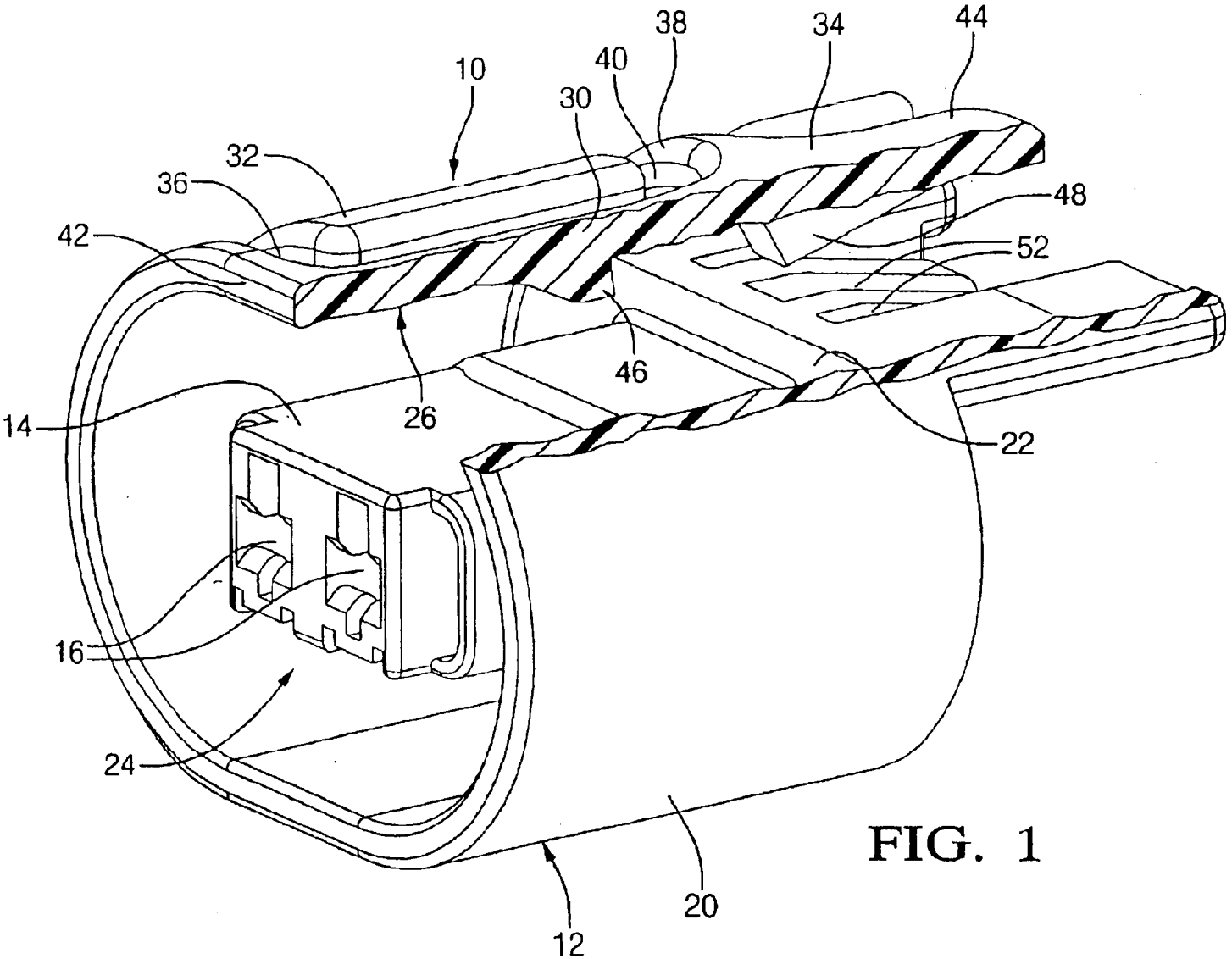
FIG. 1 is a front perspective view of a socket connector of the invention that is partially cut away to show internal detail.

Referring now to the drawing, the socket connector 10 of the invention comprises a connector body 12 having a terminal housing 14 with terminal cavities 16 that extend through terminal housing 14. Female electric terminals (not shown) attached to lead wires (not shown) are inserted into the rearward ends of the terminal cavities 16 and retained in the terminal cavities 16 in a conventional matter. Any suitable female terminals and lead wires may be used.

Connector body 12 includes an annular shroud 20 that is integrally connected to a mid portion of the terminal housing 14 by a perpendicular end wall 22. Shroud 20 and end wall 22 form a socket 24 for receiving a plug connector 60 that has male terminals that mate with the female terminals in terminal housing 14 when the plug connector is plugged into the socket 24. Connector body 12 has a connector lock indicated generally at 26 for retaining the plug connector in the socket 24. The connector lock 26 is incorporated into the shroud 20 of the connector body 12 so as to provide a low profile socket connector as described below.

Figure 4:
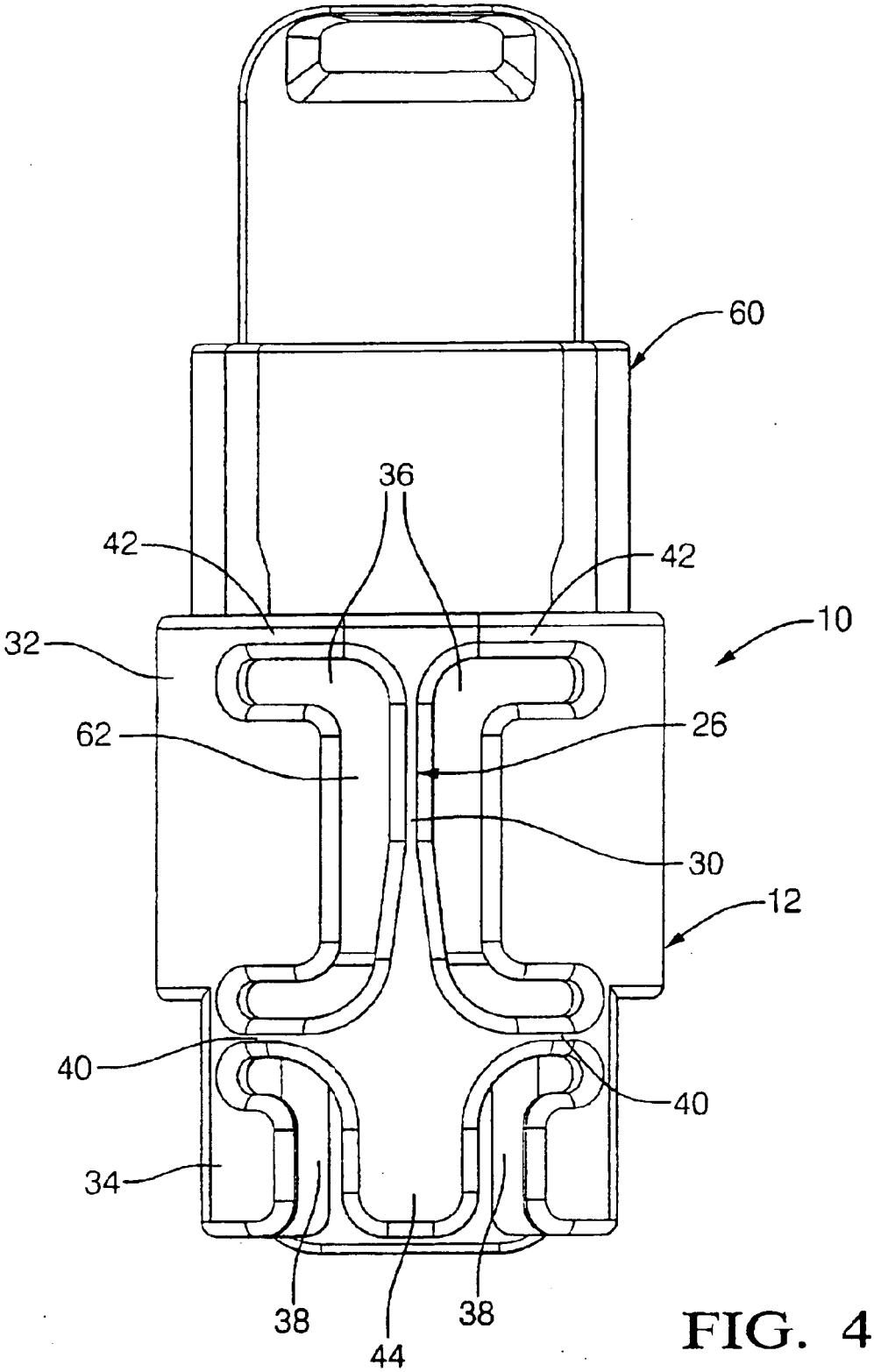
FIG. 4 is a top view of the socket connector and the plug connector of FIG. 2.

Connector lock 26 comprises an arm or beam 30 that is formed out of a forward exterior wall portion 32 of the shroud 20 itself and a rearward exterior wall portion 34 of the shroud 20 that extends rearward of end wall 22. Arm 30 is formed by forward and rearward pairs of through slots 36, 38 that extend through the forward and rearward exterior wall portions 32 and 34. The forward pair of through slots 36 extend through forward portion 32 and a forward portion of rearward portion 34 of shroud 20 as best shown in FIG. 4. The rearward pair of through slots 38 extend through the aft portion of the rearward exterior wall portion 34.

Both pairs of through slots 36 and 38 have longitudinal parts and transverse parts so that the two-pairs of through slots 36 and 38 cooperatively form flexible straps 40 that connect arm 30 to the remainder of the exterior wall of the shroud 20, specifically, the rearward exterior wall portion 34.

The forward pair of through slots 36 are preferably generally U-shaped so that there are second forward transverse parts that provide flexible straps 42 at the front end of the shroud 20. Flexible straps 42 provide a continuous front edge and anti-tangle feature for shroud 20 while allowing the front of arm 30 to bow outwardly to operate the connector lock as explained below. The rearward through slots 38 are generally L-shaped so that the aft end of arm 30 forms a depressible "pump handle" release lever 44 that is free of the extended rearward exterior wall portion 34 of shroud 20.

Arm 30 has a lock nib 46 that is located between straps 40 and 42 in the longitudinal direction and that extends inwardly into socket 24. Arm 30 also has and a triangularly shaped fulcrum 48 that extends inwardly into a space behind the end wall 22 of socket 24. The triangularly shaped fulcrum 48 slopes outwardly in the rearward direction. The end wall 22 at the inner end of socket 24 has a window 50 to facilitate molding lock nib 46 and triangularly shaped fulcrum 48 preferably also has a slot aligned with lock nib 46 longitudinally to further facilitate molding lock nib 46.

Connector body 12 has a triangular shaped fulcrum support 52 that is connected to end wall 22 and that slopes inwardly in the rearward direction. Fulcrum support 52 is located beneath the fulcrum 48 with its high point substantially aligned with the high point of fulcrum 48 to facilitate depression of release lever 44. Fulcrum support 52 may also have a slot to facilitate molding.

Figure 2:
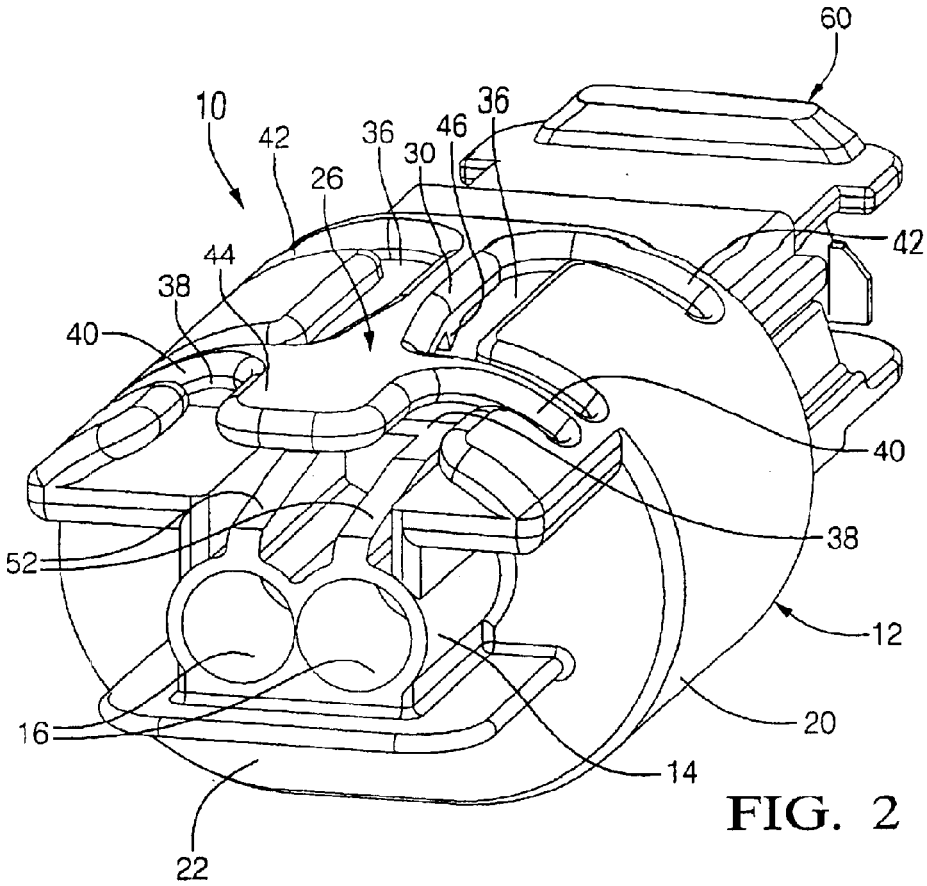
FIG. 2 is a rear perspective view of the socket connector of FIG. 1 connected to a plug connector.
Figure 3:
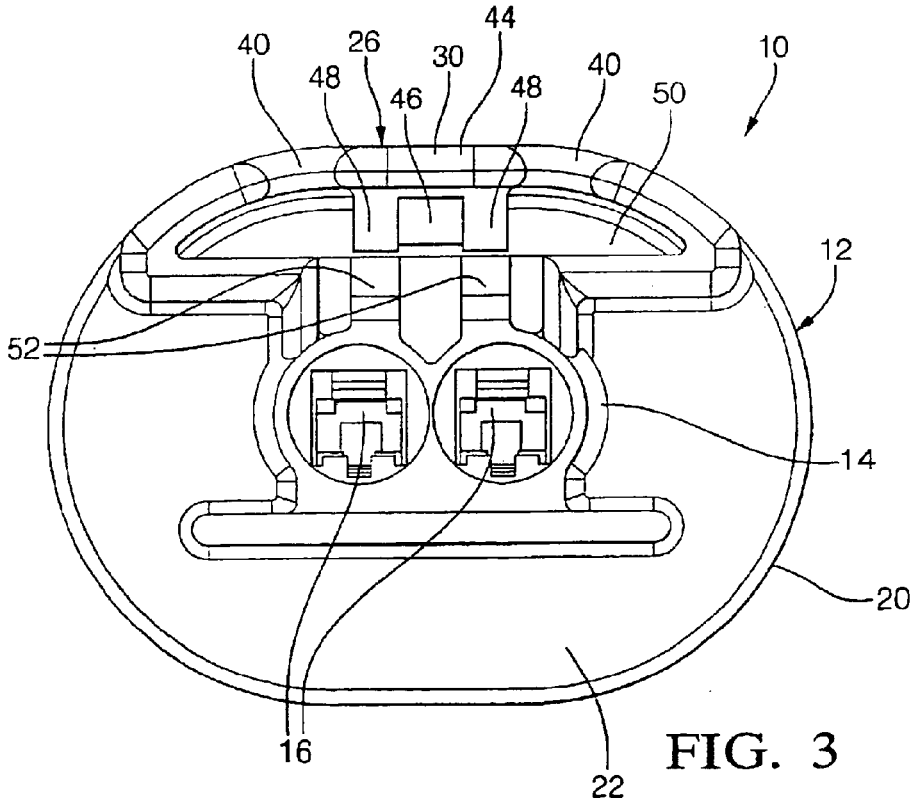
FIG. 3 is a rear view of the socket connector of FIG. 1.

Socket connector 10 mates with a plug connector 60 that includes a forward plug portion 62 that plugs into socket 24 as shown in FIGS. 2 and 4. In operation, due to the flexibility of the lock arm 30 and the straps 40 and 42 the lock nib 46 snaps over a lock shoulder (not shown) of the plug connector 60 when the plug portion 62 of the plug connector 60 is plugged into socket 24. Lock nib 46 thus retains the plug portion 62 of the plug connector 60 in the socket 24. In order to disconnect the plug connector 60, the end of "pump handle" release lever 44 is depressed manually, which causes the fulcrum 48 to engage the fulcrum support 52 and bow the forward portion of lock arm 30 outwardly so that the lock nib 46 is moved outwardly out of engagement with the lock shoulder of the plug connector 60. The plug connector 60 is then pulled away from socket connector 10. Although, lock arm 30 is preferably connected to the remainder of shroud 20 both at the front end and rearward portion of the shroud 20, the flexibility of lock arm 30 and straps 40 and 42 is sufficient to lift the lock nib 46 out of engagement with the lock shoulder of the plug connector 60.

While the exterior wall 32 of the shroud 20 is illustrated as being generally elliptical, the exterior wall can be another shape, such as round, square or rectangular. In essence, the height or profile of any shape of connector can be reduced to provide a low profile connector so long as the exterior wall of the shroud has a lock arm located in a portion of the exterior wall of the shroud itself.

In other words, it will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A low profile socket connector having a shroud for receiving a plug connector and a connector lock for retaining the plug connector when it is plugged into the socket connector comprising:

the shroud having an exterior wall, the exterior wall having through slots extending through the exterior wall to form a lock arm connected to the remainder of the exterior wall of the shroud by flexible straps, the lock arm having a lock nib that is spaced from the flexible straps and that extends inwardly of the lock arm to provide the connector lock for retaining the plug connector when it is plugged into the shroud, the lock arm having a depressible release lever, and the lock arm having a fulcrum located between the lock nib and the depressible release lever that extends inwardly of the lock arm for engaging a fulcrum support of the socket connector whereby the lock nib is moved outwardly away from the plug connector when the depressible release lever is depressed to release the plug connector.

2. The low profile socket connector as defined in claim 1 wherein the lock arm is located in a portion of the exterior wall of the shroud.

3. The low profile socket connector as defined in claim 1 wherein the exterior wall of the shroud has a first pair of through slots and a second pair of through slots that cooperatively provide a first pair of flexible straps connecting a mid portion of the lock arm to the remainder of the shroud.

4. The low profile socket connector as defined in claim 3 wherein the second pair of through slots are L-shaped to provide that the release lever be free of the remainder of the shroud.

5. The low profile socket connector as defined in claim 4 wherein the first pair of through slots are U-shaped to provide a second pair of flexible straps that connect a forward end of the lock arm to the remainder of the shroud to provide a continuous front end for the shroud.

6. A low profile socket connector having a connector body and a shroud connected to the connector body by an end wall to provide a socket for receiving a plug connector and a connector lock for retaining the plug connector when it is plugged into the socket connector comprising:

the shroud having a forward exterior wall portion and a rearward exterior wall portion, the rearward exterior wall portion extending rearward of the end wall connecting the shroud to the connector body, the shroud having through slots extending through the forward and rearward exterior wall portions to form a lock arm beam connected to the remainder of the exterior wall portions of the shroud by a first pair of flexible straps, the lock arm having a lock nib that is forward of the first pair of flexible straps and that extends inwardly of the lock arm to provide the connector lock for retaining the plug connector when it is plugged into the shroud, the lock arm having a depressible release lever rearward of the first pair of flexible straps, and the lock arm having a fulcrum located between the lock nib and the depressible release lever for engaging a fulcrum support of the connector body whereby the lock nib is moved outwardly away from the plug connector when the depressible pump handle is depressed to release the plug connector.

7. The low profile socket connector as defined in claim 6 wherein the first pair of through slots extend through the forward exterior wall portion of the shroud and a forward portion of the rearward exterior wall portion of the shroud that extends rearward of the end wall of the socket.

8. The low profile socket connector as defined in claim 7 wherein the first pair of through slots are generally U-shaped to provide a second pair of flexible straps connecting a forward end of the lock arm to the remainder of the shroud at a front end of the shroud.

9. The low profile socket connector as defined in claim 7 wherein the second pair of through slots extend through an aft portion of the rearward exterior wall portion of the shroud.

10. The low profile socket connector as defined in claim 9 wherein the second pair of through slots is L-shaped.

11. A low profile socket connector having a shroud for receiving a plug connector and a connector lock for retaining the plug connector when it is plugged into the socket connector comprising:

the shroud having an exterior wall, the exterior wall having through slots extending through the exterior wall to form a lock arm connected to the remainder of the exterior wall of the shroud by forward and rearward pairs of flexible straps, the lock arm having a lock nib that is located between the forward and rearward pairs of flexible straps and that extends inwardly of the lock arm to provide the connector lock for retaining the plug connector when it is plugged into the shroud, the lock arm having a depressible release lever, and the lock arm having a fulcrum located between the lock nib and the depressible release lever that extends inwardly of the lock arm for engaging a fulcrum support of the socket connector whereby the lock nib is moved outwardly away from the plug connector when the depressible release lever is depressed to release the plug connector.

12. The low profile socket connector as defined in claim 11 wherein the lock arm is located in a portion of the exterior wall of the shroud.

13. The low profile socket connector as defined in claim 11 wherein the second pair of flexible straps are L-shaped so that the depressible release lever is free of the remainder of the shroud.

14. The low profile socket connector as defined in claim 12 wherein the second pair of flexible straps are L-shaped so that the depressible release lever is free of the remainder of the shroud.

* * * * *